United States Patent [19]

Mekenitsky et al.

[11] 3,955,376

[45] May 11, 1976

[54] FREEZING PLANT

[76] Inventors: Shimon-Semen Yankelevich Mekenitsky, Novolesnaya ulitsa, 3, korpus 2, kv. 25; Vasily Matveevich Gorbatov, prospekt Mira, 74, kv. 70, both of Moscow; Vladimir Stepanovich Grigoriev, ulitsa Kutuzova, 5, Kaliningrad; Vikenty Petrovich Zaitsev, ulitsa Supruna, 4/10, kv. 27, Moscow; Alexei Grigorievich Ionov, pereulok Engelsa, 6, kv. 4, Kaliningrad; Vyacheslav Ivanovich Khromov, Volgogradsky prospekt, 71, korpus 2, kv. 200, Moscow; Ivan Platonovich Shvachko, ulitsa Dmitrova, 34, kv. 9; Lev Vasilievich Klimtsov, ulitsa Chernyakhovskogo, 74b, kv. 14, both of Kaliningrad, all of U.S.S.R.

[22] Filed: Mar. 28, 1974

[21] Appl. No.: 455,960

[30] Foreign Application Priority Data

Mar. 29, 1973 U.S.S.R. ..... 1899339

[52] U.S. Cl. ..... 62/341; 62/378; 198/20 R; 214/1 BB

[51] Int. Cl.[2] ..... F25C 5/14

[58] Field of Search ..... 62/341, 378, 382; 198/218, 20; 100/93 P, 207, 215; 214/1 BB, 1 BT

[56] References Cited

UNITED STATES PATENTS

| | | | |
|---|---|---|---|
| 2,132,516 | 10/1938 | Paxton et al. | 100/207 X |
| 2,615,309 | 10/1952 | De More | 62/341 X |
| 2,780,927 | 2/1957 | Boyce et al. | 62/341 |
| 3,630,391 | 12/1971 | Wilson | 214/1 BB |
| 3,732,989 | 5/1973 | Cagle | 214/1 BB |
| 3,771,669 | 11/1973 | Maggioni | 214/1 BB |

*Primary Examiner*—William F. O'Dea
*Assistant Examiner*—Ronald C. Capossela
*Attorney, Agent, or Firm*—Holman & Stern

[57] ABSTRACT

In a freezing plant, a handling device comprises vertically extending guides fixed to a base and supporting a double-deck carriage, the lower deck of the carriage comprising a frame, and the upper deck comprising a platform which is adapted to receive carriers containing a product after the loading thereof, horizontally extending guides carrying bars serving for feeding the carrier with the product to the carriage platform, further translation thereof into a space between cooling plates and returning the empty carrier back for the loading, as well as at least one stop located under the carriage and serving for expelling the product from the carrier, the carrier being delivered, after the freezing of the product, to the carriage frame during its lowering down.

3 Claims, 6 Drawing Figures

FREEZING PLANT

BACKGROUND AND SUMMARY OF THE INVENTION

The present invention relates to freezing plants which are widely used in the foodstuff industry.

Known in the art is a rotary-type freezing plant for continuous freezing of food products in a space between the cooling plates of the rotor having a handling device.

The handling device comprises two independent assemblies.

The loading assembly is arranged outside the insulated circuit of the plant and comprises a platform accomodating a carrier which is made in the form of a frame to be filled with a product, the platform performing reciprocations for introducing the carrier with the product into the space between the cooling plates of the rotor. The unloading assembly is arranged inside the insulated circuit and comprises a cam system for moving the cooling plates apart, a mechanism for stripping the frozen product from the plate in case of the adhering thereof to the plate, and a mechanism for delivering the carrier with the frozen product outside of the insulated circuit (cf. U.S.S.R. Inventor's Certificate No. 269,940, Int. Cl. F 25 d).

The product to be frozen is manually placed into the carrier mounted on the platform. Then the platform supporting the carrier enters the space between the cooling plates of the rotor and, returning into the initial position, abandons the carrier with the product in the rotor. The product is frozen during the rotation of the rotor. Upon completion of the freezing, the cooling plates supporting the carrier with the product are stopped at the unloading station. Then the mechanism for stripping the frozen product is actuated so as to separate it from the surface of the cooling plates by shifting the product relative thereto. Then the plates are spaced apart by means of the cam system, and the carrier with the frozen product slides down under gravity to an inclined trough, wherefrom it is delivered outside the insulated circuit to a table, where the product is manually extracted from the carrier and the carrier is manually returned back for re-use.

As will be apparent from the above description of the operation of the prior art freezing plant, manual labour is employed at certain stages so that the operation of the plant is rather expensive. Furthermore, manual extraction of the product from the carrier results in a rapid wear thereof. Since there is no provision for precompaction of such products as meat, fish and the like which do not have regular shape and dimensions, the distance between the cooling plates must be oversized to accommodate the largest dimension. This results in increased overall dimensions of the freezing assembly. The arrangement of the loading assembly inside the insulated circuit results in lower reliability of its mechanisms due to abrupt temperature fluctuations.

SUMMARY OF THE INVENTION

It is an object of the present invention to provide a freezing plant which promotes the elimination of manual labour for extracting a frozen product from the carrier and for returning the carrier back for re-use, whereby the service life of the carrier may be prolonged.

Another object of the invention is to provide a freezing plant having increased reliability in operation due to the fact that the handling device is arranged outside the insulated circuit.

The above objects are accomplished due to the fact that in a freezing plant, wherein carriers with a product are placed in a space between cooling plates by means of a handling device and are delivered therefrom after the freezing, in accordance with the invention, the handling device comprises vertically extending guides fixed to a base and supporting a double-deck carriage, the lower deck of the carriage comprising a frame, and the upper deck comprising a platform adapted to receive the carrier with the product after the loading thereof, horizontally extending guides carrying bars for feeding the carrier containing the product to the platform of the carriage, further translation thereof into the space between the cooling plates and returning of the empty carrier back for the loading, as well as at least one stop located under the carriage and serving to expell the product out of the carrier, the carrier being fed, after the freezing, to the carriage frame during the lowering thereof.

Furthermore, a mechanism for precompacting the product is preferably provided under the carriage, this mechanism comprising a plate and spring-loaded levers connected to the plate by means of draw-bars.

The bars of the plant may be bars with a slit at the free end. They are preferably mounted on the horizontally extending guides so as to be rotatable in a vertical plane by means of jacks and reciprocatable along the guides by means of jacks which are operatively connected to the grippers by means of a lever.

The present invention includes the following features.

The use of the vertically movable double-deck carriage enables the combination of the loading and unloading assemblies in a single handling device which performs labour-consuming production operations outside the insulated circuit of the plant, thereby providing for high operative reliability of the freezing plant.

The structural combination of the loading and unloading assemblies ensures the continuous mechanized operation of the freezing plant beginning with the loading of the product, including its placing in the space between the cooling plates and finally until the unloading of the frozen product from the cooling space, its extraction from the carrier and transporting to the packaging table.

Due to the mechanization of the extraction of the product from the carrier after the freezing, the manual labour is completely eliminated at this stage, and the wear of the carriers is substantially reduced. The carrier here means a container into which there is placed a product to be frozen. The carrier may be of various design depending on the number and type of the stops, e.g. it may comprise a frame (without a bottom wall) or with the bottom wall having slots for cooperating with the stops during the unloading of the frozen product.

The availability of the precompaction mechanism ensures the maintenance of a preselected height of the carrier filling with the product so as to provide for a minimum spacing between the cooling plates during the loading, whereby the overall dimensions of the freezing plant can be reduced.

The embodiment of the handling device according to the invention does not depend, in principle, on the design of the other components of the freezing plant, such as of the freezing assembly thereof, whereby it may be successfully used in the freezing plants of any type, such as, for example, in the rotary-type freezing plants or in the plants with horizontally extending cooling plates, wherein the operations of the loading and unloading of the product are performed at one and the same level.

The invention will be better understood from the following detailed description of the embodiments thereof with reference to the accompanying drawings, in which:

DESCRIPTION OF THE PREFERRED EMBODIMENTS

Figure 1:
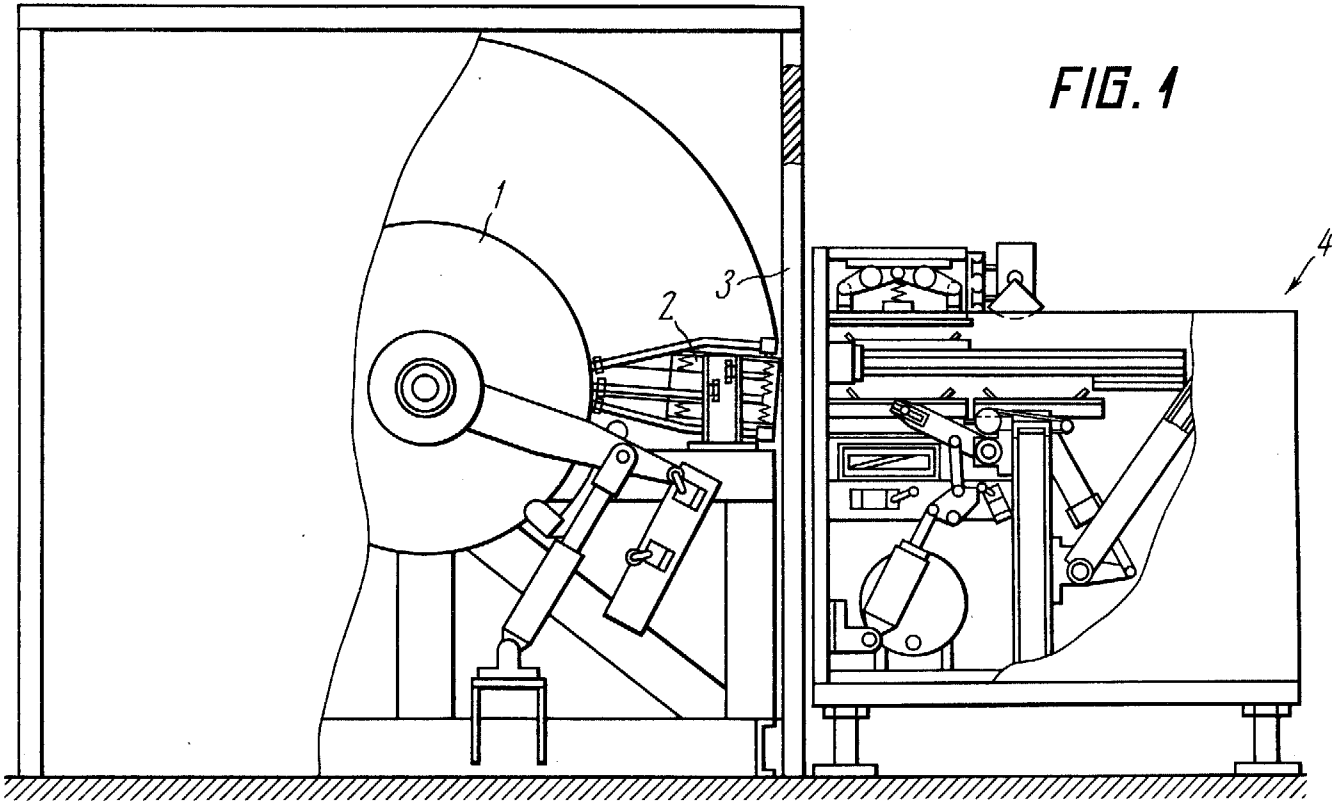
FIG. 1 shows a side elevation of a rotary-type freezing plant partially in section.

The freezing plant shown in the drawings comprises a rotor 1 (FIG. 1) having radially extending cooling plates 2 and a handling device 4 located outside the insulated circuit 3.

Figures 2, 3:
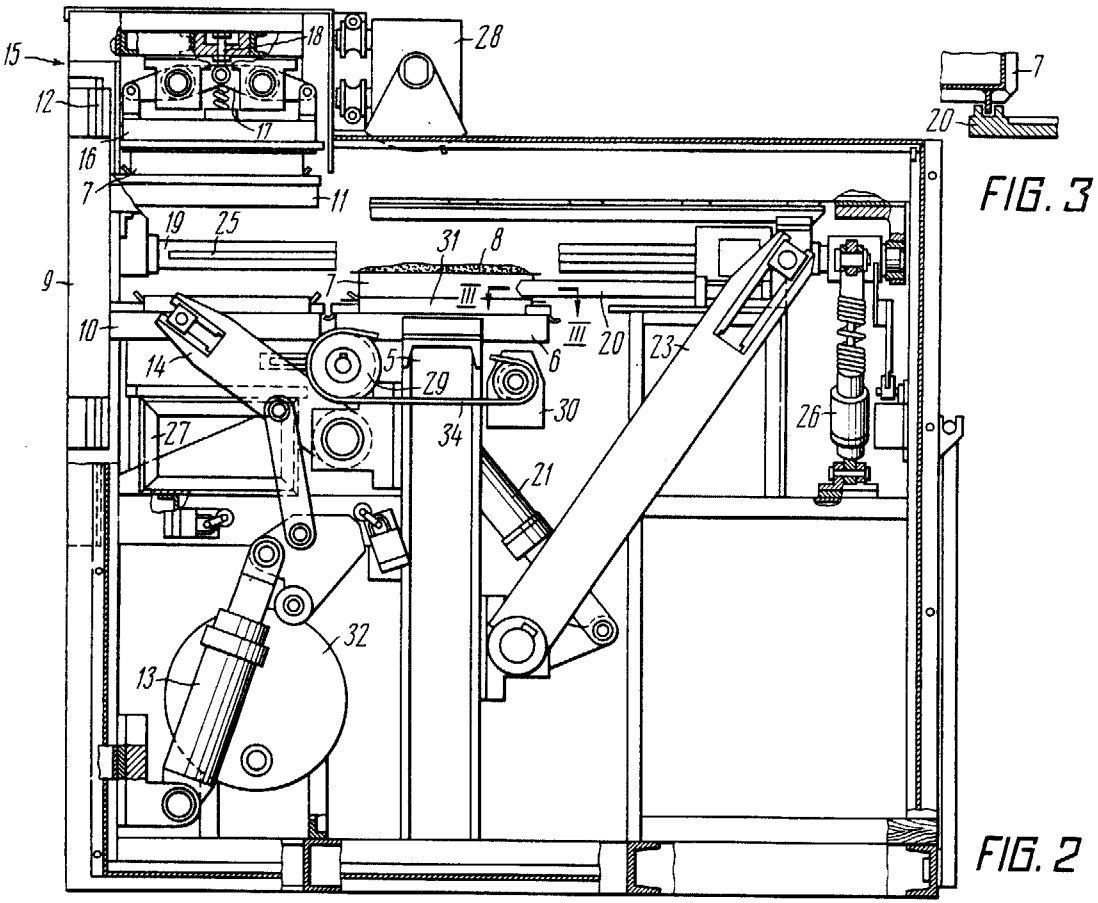
FIG. 2 shows an enlarged side elevation of the handling device.
FIG. 3 is an enlarged sectional view taken along the line III—III in FIG. 2.

The handling device 4 comprises a base 5 (FIG. 2) having a horizontal portion 6 for placing thereon a carrier 7 containing a product 8, a double-deck carriage 9 having the lower deck comprising a frame 10 and the upper deck comprising a platform 11. The carriage 9 is vertically movable along guides 12 by means of a mechanism comprising a hydraulic jack 13 which is connected to the frame 10 of the carriage 9 by means of a lever arrangement 14. A precompaction mechanism 15 is mounted above carriage 9 and comprises a plate 16 and spring-loaded levers 18 connected thereto by means of draw-bars 17.

In order to accommodate the carrier 7 with the product 8 on the horizontal portion 6 of the base 5 there are provided horizontally extending cylindrical guides 19 carrying bars with a slit at the free end 20 (FIG. 3) which are reciprocatable by means of hydraulic jacks 21 and 22 (FIGS. 4, 5) via levers 23. The bar 20 are provided with keys 24 received in keyways 25 (FIG. 2) of the guides 19 so that the bar 20 are rotatable in a vertical plane together with the guides 19 at a certain angle of about 16° by means of a hydraulic jack 26.

Stops 27 are mounted under the carriage 9 for expelling the frozen product 8 out of the carrier 7.

A metering hopper 28 is mounted above the loading station for feeding and metering the product into the carrier 7.

A screw conveyor 29 driven by a hydraulic motor 30 is mounted adjacent to the stops 27 for delivering the frozen product to a packaging table (not shown).

In order to prevent the carrier 7 from being displaced on the horizontal portion 6 of the base 5 during the placing of the product therein, there are provided rigidly fixed end stops (FIG. 2) comprising check blocks.

Figure 4:
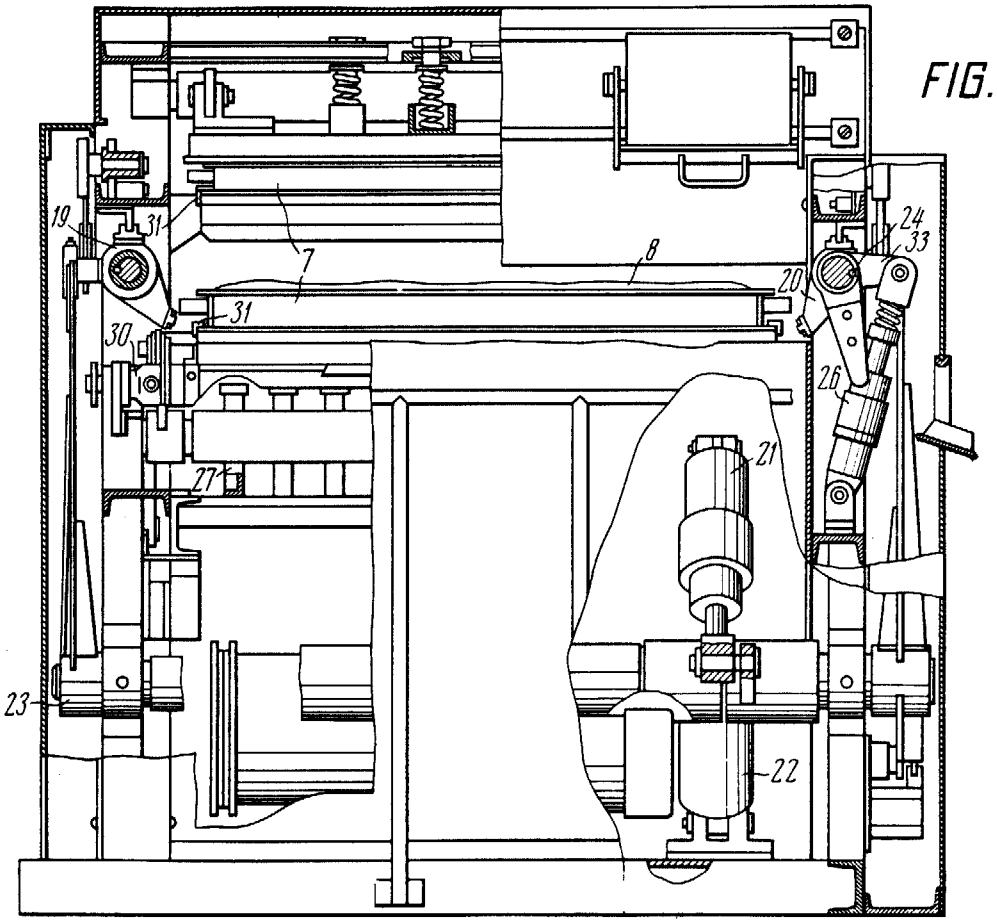
FIG. 4 is a front elevation of the handling device partially in section.
Figure 5:
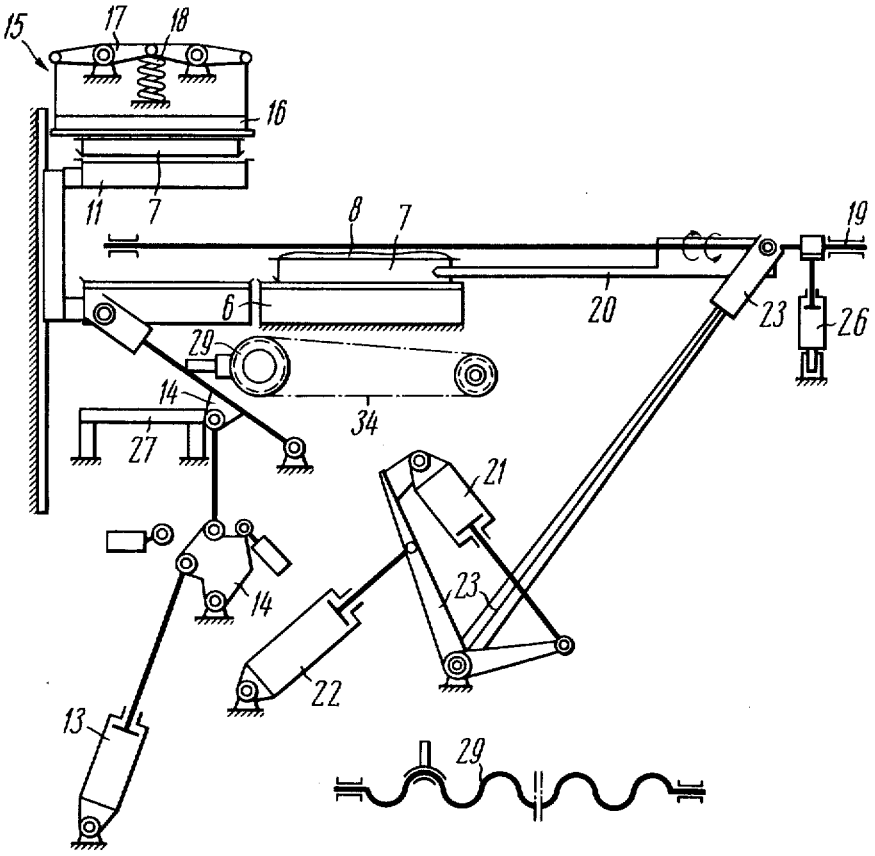
FIG. 5 shows a schematic of the handling device.

Similar stops 31 are provided on the decks of the carriage 9 (FIG. 4). These stops, which are mounted on the frame 10 serve for retaining the carrier 7 during the unloading, thereby facilitating the extraction of the product from the carrier, while the same stops mounted on the platform 11 of the carriage 9 ensure accurate positioning of the carriers relative to the cooling plates 2 during the loading of the carrier 7 into the rotor 1.

The freezing plant according to the invention functions as follows.

A greaseproof paper package pattern is placed in the carrier 7 (FIG. 5) mounted on the horizontal portion 6 of the base 5, and a product (meat, fish or the like) is fed from the metering hopper 28 into the package pattern and is manually distributed and packaged.

Figure 6:
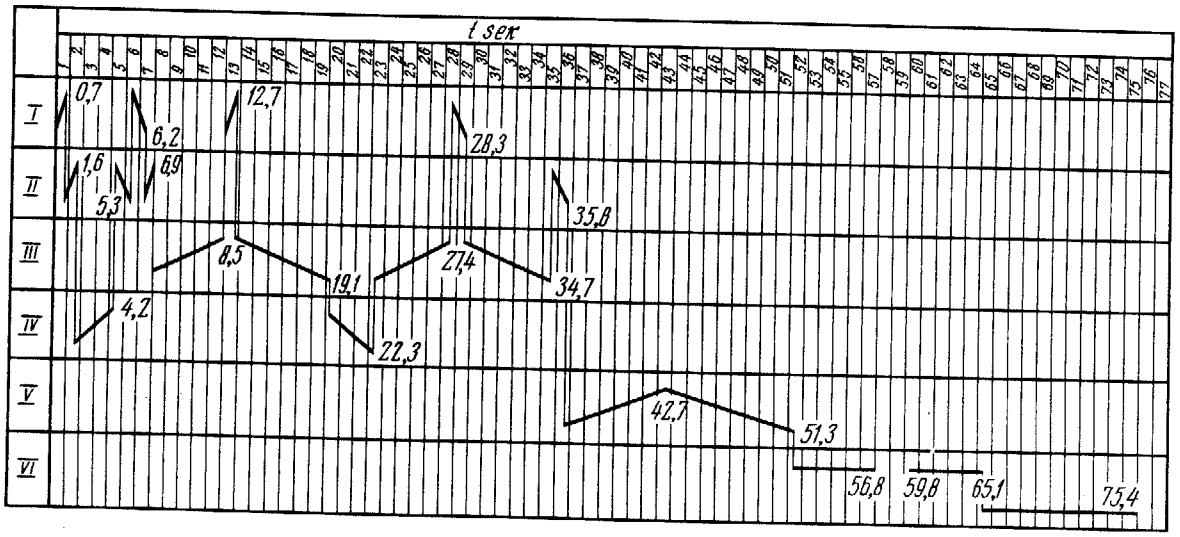
FIG. 6 shows a cyclogram illustrating the operation of the freezing plant.

The time sequence of the operation of the freezing plant will now be illustrated with reference to a cyclogram (FIG. 6) in which the stages of operation of the mechanisms are indicated by Roman numerals.

An operator starts a hydraulic control unit 32 (FIG. 2) which ensures the actuation of all hydraulic jacks of the plant in a preselected sequence. Upon actuation of the hydraulic jack 26 and by means of a lever 33 the horizontally extending guides 19 carrying the bar 20 are rotated at an angle of about 16° so that the bar are engaged with the carrier 7 filled with the product (operation I). The hydraulic jack 21, via the leverage 23, moves the bar 20 along the guides 19 so as to feed the carrier 7 containing the product 8 to the platform 11 of the carriage 9 (operation II). At this stage the platform 11 is at the same level with the horizontal portion 6. The hydraulic jack 13, via the leverage 14, lifts the carriage 9 along the guides 12 into the upper position (operation IV) at which the product 8 contained in the carrier 7 is brought in contact with the plate 16 of the precompacting mechanism 15. During the upward movement of the carriage 9, the carrier 7 containing the product 8 is disengaged from the bar 20, while an empty carrier 7 placed on the frame 10 of the movable carrier 9 is engaged with the bars with a slit at the free end 20, and the latter translate the empty carrier 7 under the action of the hydraulic jack 21 and the leverage 23 to the horizontal portion 6 for subsequent filling with the product (operation II). Then the cylindrical guides 19 are rotated, by means of the hydraulic jacks 26 and the lever 33 at a certain angle so that the fork-shaped grippers 20 are disengaged from the carrier 7 (operation I).

The hydraulic jacks 21 and 22, which are actuated in sequence, move the bar 20 and introduce them into the space between the cooling plates 2 (operation II and III). During the rotation of the rotor 1 the plates 2 are brought to the handling station and are spaced apart thus enabling unobstructed performance of these operations.

Then the hydraulic jacks 26 are again actuated (operation I), the bars 20 are engaged with the carrier 7 filled with the frozen product, and due to the return stroke of the piston of the hydraulic jack 22, the bars 20 deliver the carrier 7 to the frame 10 of the movable carriage 9 (operation III). Then the carriage in lowered down by means of the hydraulic jack 13 and the leverage 14 (operation IV). Therefore, the carrier 7 containing the frozen product is disengaged from the bars 20, while the carrier 7 containing the precompacted product on the platform 11 is engaged with the bars and stopped at the station for the loading of the now unoccupied space between the cooling plates 2.

During the lowering down of the carriage 9, the frozen product in the carrier 7 is placed on the stops 27 and remains thereon, whereas the frame 10, while retaining the carrier 7 by means of the stops 31, continues its downward movement until the complete extraction of the product from the carrier 7. After that the hydraulic jack 22 is actuated (operation III), and the bars 20 introduce the carrier 7 containing the precompacted product 8 into the now unoccupied space between the cooling plates 2. The hydraulic jacks 26 disengage the bars 20 from the carrier 7 (operation I), while the hydraulic jacks 21 and 22 return them back into the initial position corresponding to the beginning of the operation cycle of the plant mechanisms (operations III and II).

The next operation V is the rotation of the rotor 1 (FIG. 1), at which the cooling plates 2 with the frozen product are stopped at the handling station. Then the hydraulic motor 30 is actuated so as to drive, via a chain transmission 34 (FIGS. 2 and 5), the screw conveyor 29 (operation VI) which delivers the frozen product outside the freezing plant.

At that stage the operation cycle of the freezing plant is completed.

As it will be apparent from the above description, the operations of the extraction of the frozen product from the carrier and return of the carrier back for re-use are completely mechanized so that no manual labour is required for performing these operations, while the service life of the carriers is prolonged.

What is claimed is:

1. A freezing plant having cooling plates and a handling device for placing carriers containing a product into a space between said cooling plates and delivers them from this space after the freezing, said handling device comprising: a base, vertically extending guides fixed to said base; a double-deck carriage having a lower deck and an upper deck, said carriage being movably mounted on said guides, the lower deck of the carriage comprising a frame, and the upper deck comprising a platform for receiving the carrier containing the product, horizontally extending guides, bars reciprocatably and rotably mounted on said horizontally extending guides for feeding the carrier containing the product to said platform of the carriage, further translation thereof into the space between said cooling plates and returning the empty carrier back for the loading, and at least one stop located under said carriage serving for expelling the product out of the carrier to said frame of the carriage during the lowering down thereof.

2. A plant according to claim 1, wherein there is provided a mechanism for precompacting the product located under the carriage, said mechanism comprising a plate and spring-loaded levers connected thereto by means of draw-bars.

3. A plant according to claim 1, wherein the bars have slits at their free end and are mounted on the horizontally extending guides so as to be rotatable in the vertical plane in which the reciprocation of the bars in the horizontal direction is performed by common devices operatively connected to the bars by means of a lever.

* * * * *